US005791152A

United States Patent [19]

Choi

[11] Patent Number: 5,791,152

[45] Date of Patent: Aug. 11, 1998

[54] REFRIGERATOR HAVING A DEVICE FOR GENERATING AN AIR CURTAIN AND METHOD FOR CONTROLLING AN AIR CURTAIN GENERATING OPERATION

[75] Inventor: Byung-Jun Choi, Incheon, Rep. of Korea

[73] Assignee: Daewoo Electronics Co., Ltd., Seoul, Rep. of Korea

[21] Appl. No.: 870,447

[22] Filed: Jun. 6, 1997

[51] Int. Cl.[6] ..... F25D 17/06

[52] U.S. Cl. ..... 62/89; 62/186; 62/256

[58] Field of Search ..... 62/89, 186, 255, 62/256, 408

[56] References Cited

U.S. PATENT DOCUMENTS

| | | | |
|---|---|---|---|
| 2,775,187 | 12/1956 | McClurkin | 62/256 |
| 4,058,989 | 11/1977 | Horvay et al. | 62/256 |
| 4,379,391 | 4/1983 | Rhee | 62/256 |
| 4,478,047 | 10/1984 | Ibrahim | 62/256 |
| 4,962,649 | 10/1990 | Battocletti | 62/256 |
| 5,187,941 | 2/1993 | Tershak et al. | 62/89 |
| 5,675,980 | 10/1997 | Lee | 62/186 |

*Primary Examiner*—William E. Tapolcai

*Attorney, Agent, or Firm*—Beveridge, DeGrandi, Weilacher & Young LLP

[57] ABSTRACT

A refrigerator has a device for generating an air curtain, and the air curtain generating device operates according to the sensor for sensing the opening/closing of the door and the temperatures in the cooling compartment sensed by temperature sensors. The air curtain is generated when the door is opened and when the temperature of the area near the door is higher than the temperature of the area distant from the door. Thus, the area near the door in the cooling compartment is efficiently cooled when the door is closed, and the operation for generating an air curtain is exactly performed when the door is opened even if the sensor for sensing the opening/closing of the door is out of order.

4 Claims, 4 Drawing Sheets

REFRIGERATOR HAVING A DEVICE FOR GENERATING AN AIR CURTAIN AND METHOD FOR CONTROLLING AN AIR CURTAIN GENERATING OPERATION

BACKGROUND OF THE INVENTION

1. Field of the Invention

The present invention relates to a refrigerator having a device for generating an air curtain which is operated according to the temperatures in a cooling compartment and a method for controlling an air curtain generating operation thereof.

2. Prior Art

FIG. 1 shows a conventional refrigerator, which shows a refrigerator having a device for generating an air curtain for shutting off the opening of a cooling compartment when the door is opened. The refrigerator has, as shown in FIG. 1, a cabinet 10 forming a freezing compartment 21 and a fresh food compartment 22 which are partitioned from each other by a wall 27, and a freezing compartment door 24 and a fresh food compartment door 25 which open/close the freezing compartment 21 and fresh food compartment 22 respectively.

A compressor 23 is installed in a lower rear part of the cabinet 10, and an evaporator 29 for generating cool air by evaporating refrigerant supplied from the compressor 23 is installed in the rear of the freezing compartment 21. A cooling fan 19 for blowing the cool air generated by the evaporator 29 is installed at the upper side of the evaporator 29.

A device 20 for generating an air curtain is provided in the upper side of the fresh food compartment 22. The air curtain generating device 20 comprises a cool air duct 13 provided in the upper side of the fresh food compartment 22, and a blowing fan 11 for blowing the cool air from the evaporator 29 into the cool air duct 13. The cool air duct 13 is formed with a cool air discharge port 15 at one end thereof which is opened downward at the area adjacent to an opening of the fresh food compartment 22. The cool air blown into the cool air duct 13 is discharged downward, by which the air curtain for shutting off the opening of the fresh food compartment 22 is generated.

In the fresh food compartment 22, a sensor (not shown) for sensing the opening/closing of the fresh food compartment door 25 is provided, and the blowing fan 11 is controlled to operate only when the open state of the door 25 is sensed by the sensor. Thus, the air curtain is generated only when the door 25 is open so as to prevent leakage of the cool air through the opening of the fresh food compartment 22 at the open state of the door 25.

A plurality of cool air ports 16, 18 are formed at the rear walls of the freezing compartment 21 and the fresh food compartment 22. When the door 25 is closed, the cool air from the evaporator 29 is blown by the cooling fan 19 to be supplied into the freezing compartment 21 and the fresh food compartment 22, and accordingly the foodstuffs stored in the freezing compartment 21 and the fresh food compartment 22 are frozen and refrigerated respectively.

However, in such a conventional refrigerator, there is a problem that the area adjacent to the door 25 cannot be cooled efficiently. The area adjacent to the door 25 lies in direct contact with th e outside air when the door 25 is opened, and thus the temperature thereof rises to the temperature of the outside air in a short time. But, in such a conventional refrigerator, since the area adjacent to the door 25 cannot be cooled directly, rapid and uniform cooling cannot be achieved. Moreover, since the operation of the air curtain generating device depends on the results of sensing of the sensor, the operation for generating air curtain cannot be performed exactly when the sensor is out of order or the operation of the sensor is unstable.

SUMMARY OF THE INVENTION

The present invention has been proposed to overcome the above described problems in the prior art, and accordingly it is an object of the present invention to provide a refrigerator in which the area adjacent to the door can be cooled by the air curtain generating device, and the air curtain generation operation is performed exactly despite the trouble in the operation of the sensor for sensing the opening/closing of the door.

To achieve the above object, the present invention provides a refrigerator having a cabinet forming a cooling compartment, a door mounted on said cabinet for opening/closing an opening of said cooling compartment, said refrigerator comprising: a cool air duct having a cool air port opened at an area adjacent to the opening of said cooling compartment; a fan for blowing cool air in said cool air duct to be discharged through the cool air port so as to generate an air curtain for shutting off the opening of said cooling compartment; a means for sensing opening/closing of said door; a means for sensing temperatures of areas adjacent to said door and distant from said door; a control part for controlling said blowing fan to operate when an opened door is sensed by said opening/closing sensing means and when the temperature of the area adjacent to said door is sensed by said temperature sensing means to be higher than the temperature of the area distant from said door.

It is preferable that said temperature sensing means comprises, a door temperature sensor being disposed near said door in said compartment; and a cooling compartment temperature sensor being disposed at an opposite side wall to said door in said cooling compartment.

Also, according to the present invention, a method for controlling an air curtain generating operation in a refrigerator is provided, which is a method for controlling an air curtain generating operation in a refrigerator, said refrigerator having a cabinet forming a cooling compartment, a door mounted on said cabinet for opening/closing an opening of said cooling compartment, a cool air duct having a cool air port opened at an area adjacent to the opening of said cooling compartment, a fan for blowing cool air in said cool air duct to be discharged through the cool air port, wherein an air curtain for shutting off the opening of said cooling compartment is generated by the cool air discharged through the cool air port according to an operation of said blowing fan, said controlling method comprising the steps of: sensing opening/closing of said door; operating said blowing fan if said door is opened; sensing temperatures of areas adjacent to said door and distant from said door; and controlling said blowing fan to operate when the temperature of the area adjacent to said door is sensed to be higher than the temperature of the area distant from said door.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENT

Hereinafter, the present invention will be described in detail with reference to the drawings.

Figure 1:
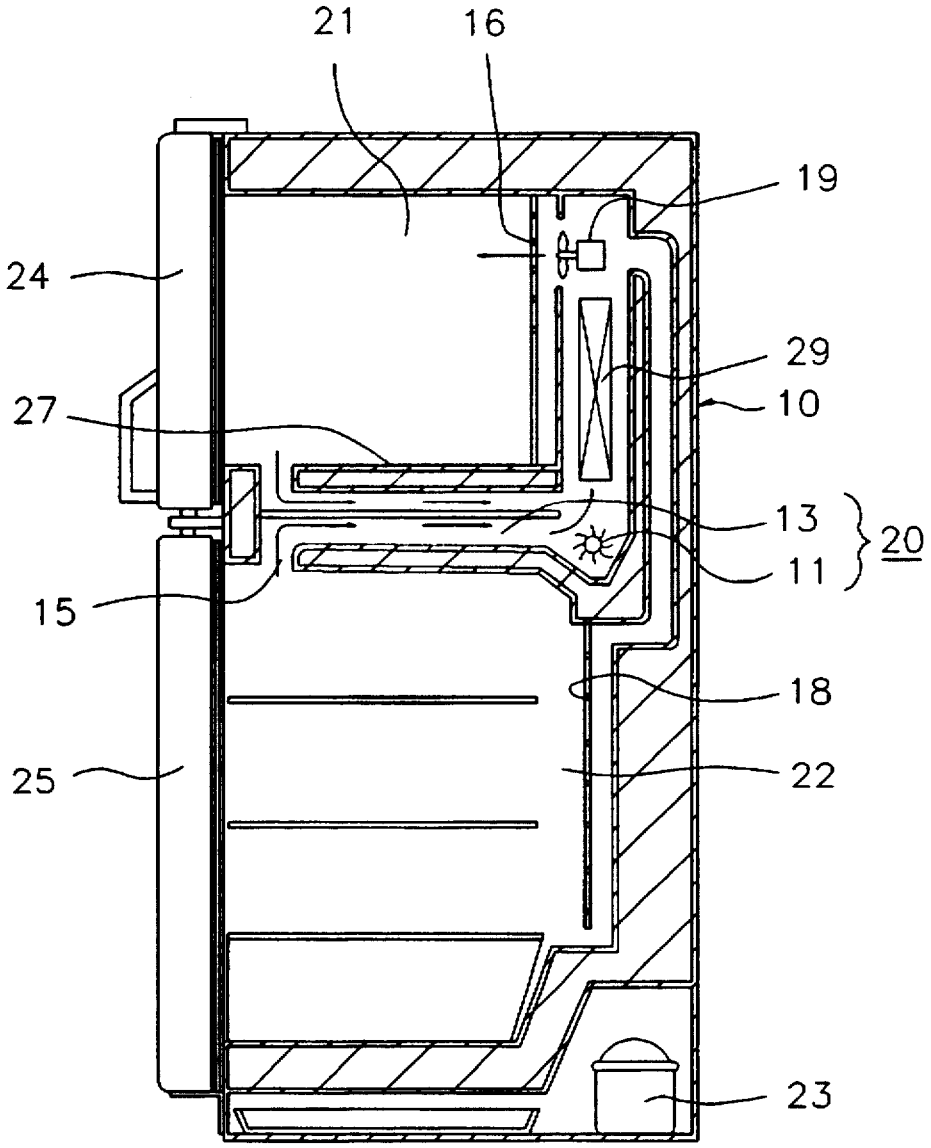
FIG. 1 PRIOR ART
FIG. 1 is a side sectional view of a conventional refrigerator having air curtain generating device.
Figure 2:
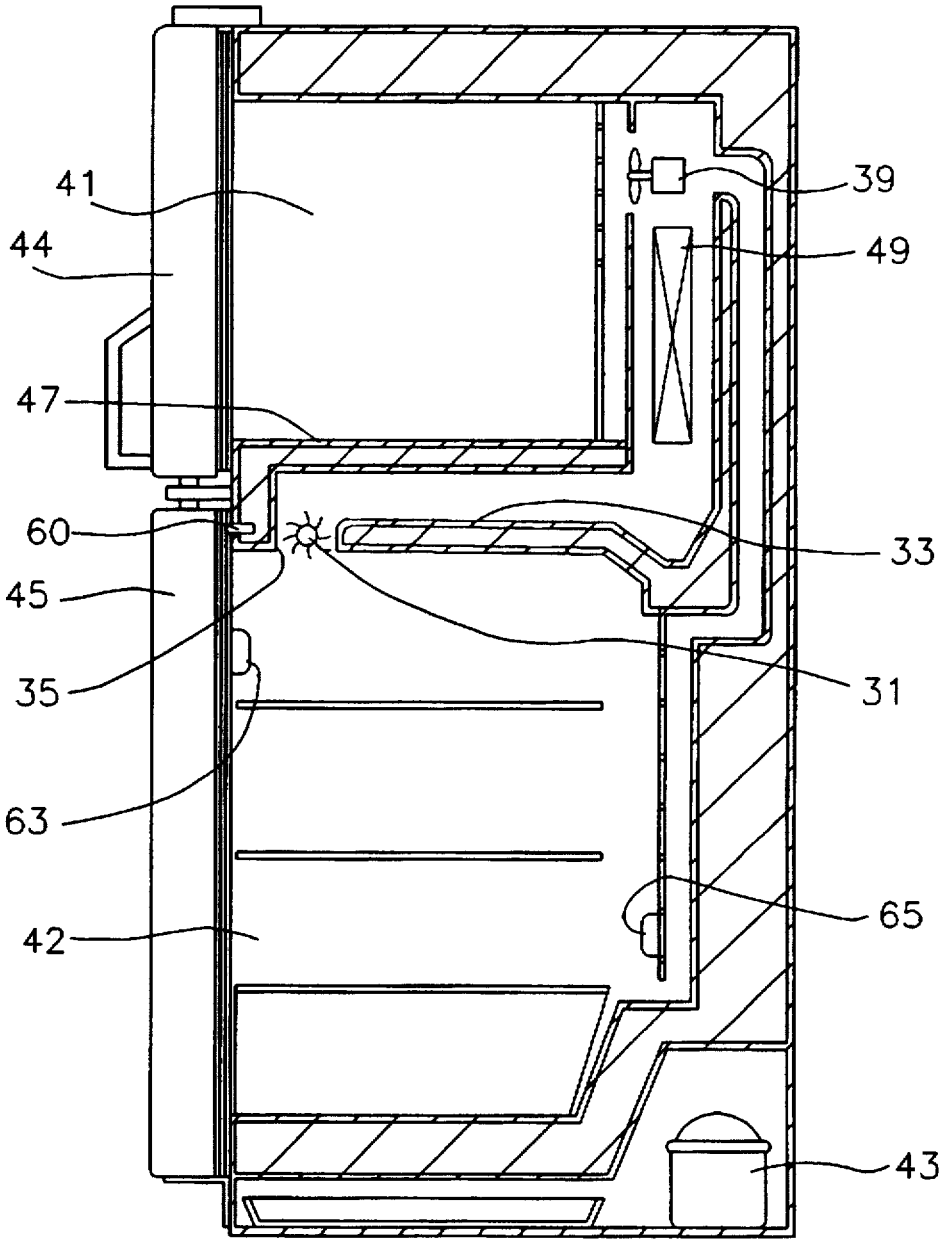
FIG. 2 is a side sectional view of a refrigerator according to the present invention.
Figure 3:
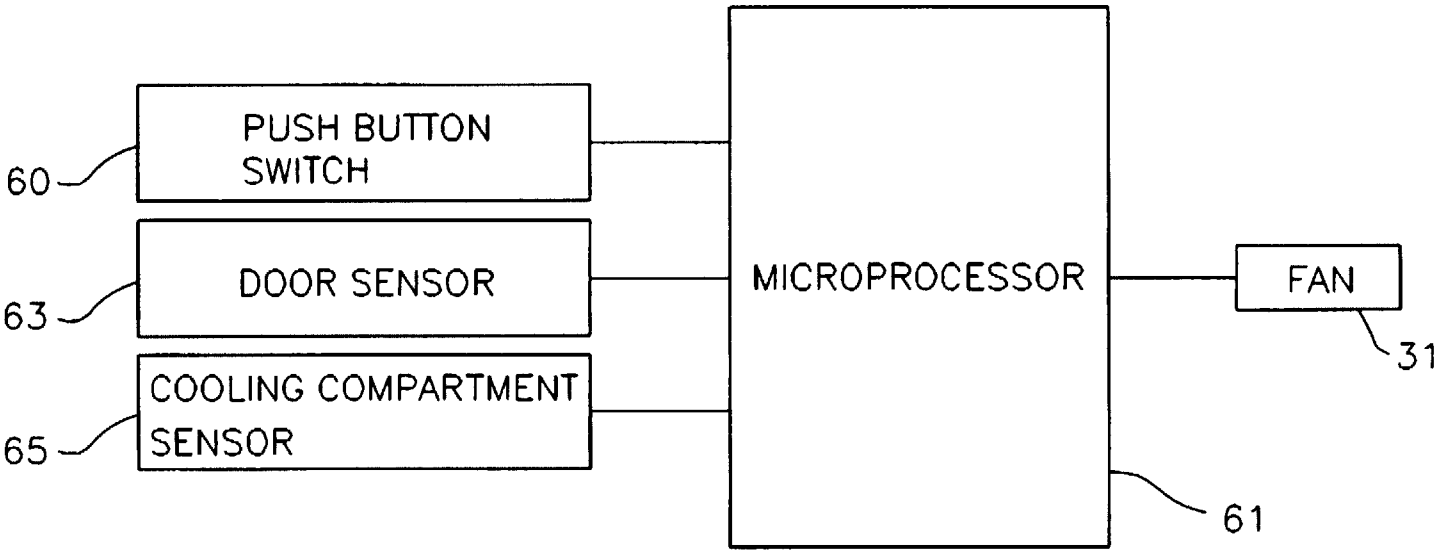
FIG. 3 is a block diagram of a part of the refrigerator according to the present invention.
Figure 4:
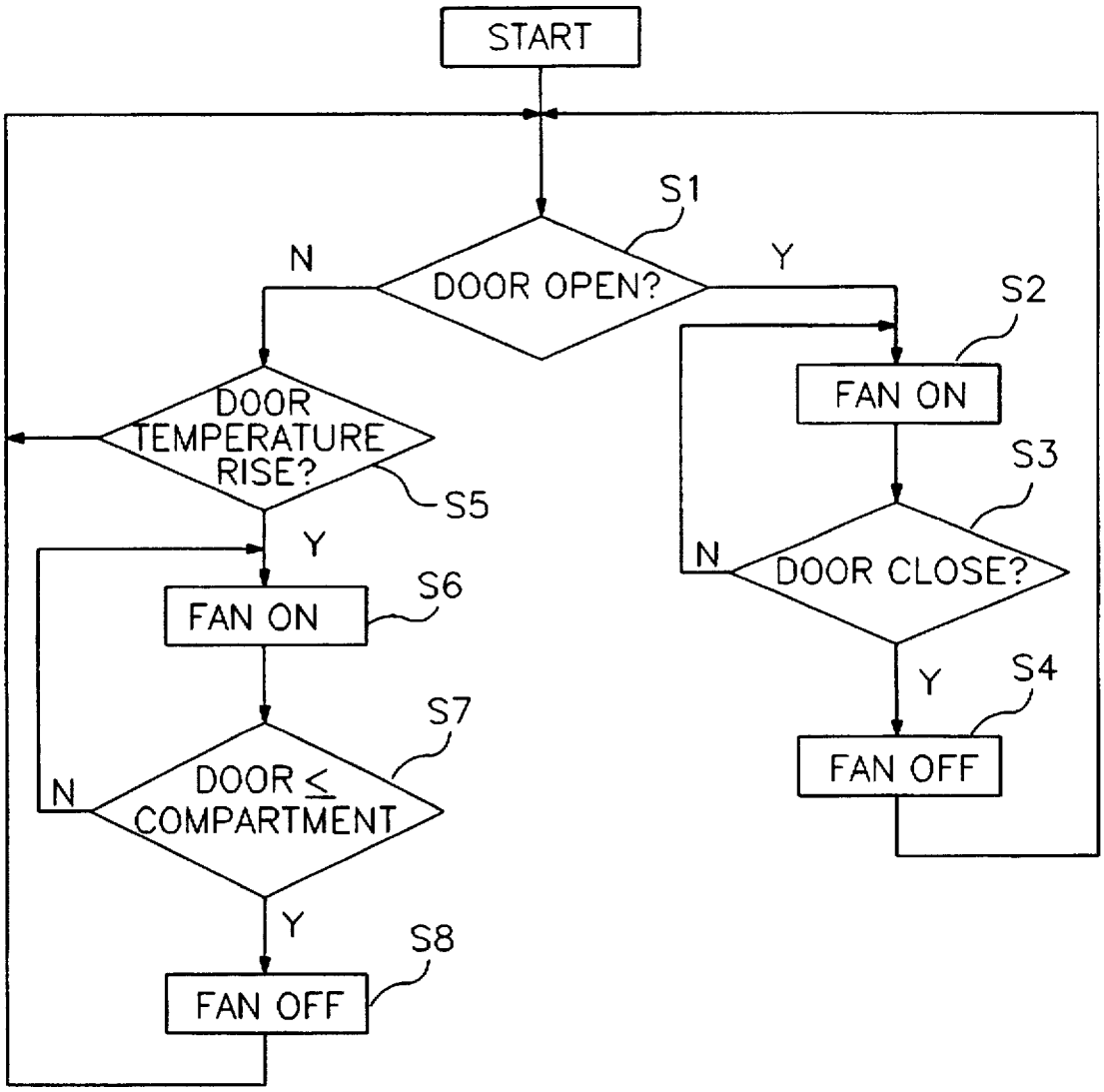
FIG. 4 is a flow chart of a controlling method according to the present invention.

FIG. 2 is a side sectional view of a refrigerator according to the present invention, and FIG. 3 is a block diagram of a part of the refrigerator according to the present invention. The refrigerator according to the present invention has, like the conventional refrigerator shown in FIG. 1, a cabinet 30 forming a freezing compartment 41 and a fresh food compartment 42 which are partitioned from each other by a wall 47, and a freezing compartment door 44 and a fresh food compartment door 45 which open/close the freezing compartment 41 and fresh food compartment 42 respectively.

A compressor 43 is installed in a lower rear part of the cabinet 30, and an evaporator 49 for generating cool air by evaporating refrigerant supplied from the compressor 43 is installed in the rear of the freezing compartment 41. At the upper side of the evaporator 49, a cooling fan 39 for blowing the cool air generated by the evaporator 49 is installed to supply the freezing compartment 41 and the fresh food compartment 42 with the cool air.

A device 40 for generating an air curtain which shuts off the opening of the fresh food compartment 42 according to the opening of the fresh food compartment door 45 is provided in the upper side of the fresh food compartment 42. The air curtain generating device 40 comprises a cool air duct 33 provided in the upper side of the fresh food compartment 42 and a blowing fan 31 for blowing the cool air from the evaporator 49 into the cool air duct 33. The cool air duct 33 is formed with a cool air discharge port 35 at one end thereof which is opened downward at the area adjacent to the opening of the fresh food compartment 42. The cool air blown into the cool air duct 33 is discharged downward, by which the air curtain for shutting off the opening of the fresh food compartment 42 is generated. For the blowing fan 31, a cross flow fan which is capable of blowing uniformly is adopted.

A push button switch 60 is installed on the front surface of the fresh food compartment 42. The push button switch 60 is pushed by the door 45 when the door 45 is closed and released when the door 45 is opened. A microprocessor 61 installed in the refrigerator senses that the door 45 is opened when the push button switch 60 is released. The blowing fan 31 operates when the push button switch 60 senses the opened door 45. Thus, the air curtain is generated when the door 45 is opened, so the leakage of the cool air is prevented when the door 45 is opened.

Two temperature sensors 63, 65 are installed in the fresh food compartment 42. The temperature sensors 63, 65 consist of a door temperature sensor 63 disposed near the inner side surface of the door 45 in order to sense the temperature of the area adjacent to the door 45 in the fresh food compartment 42, and a cooling compartment temperature sensor 65 disposed near the rear wall of the fresh food compartment 42 in order to sense the temperature of the area distant from the door 45. The temperatures sensed by the temperature sensors 63, 65 are inputted to the microprocessor 61. If the temperatures sensed by the temperature sensors 63, 63 are different from each other at more than a predetermined degree, in other words, if the temperature of the area near the door 45 is higher than the temperature of the area near the rear wall of the fresh fool compartment at more than the predetermined degree, the microprocessor 61 operates the blowing fan 31 to generate an air curtain.

Hereinbelow, the processor for controlling the refrigerator as illustrated above will be described.

During the operation of the refrigerator, the microprocessor 61 senses whether the door 45 is opened or not S1. If an opened door 45 is sensed, the microprocessor 61 operates the blowing fan 31 to generate the air curtain for shutting off the frontal opening of the fresh food compartment 42, S2. If the close state of the door 45 is sensed during the operation of the blowing fan 31, S3, the microprocessor 61 stops operating of the blowing fan 31, S4.

When the door 45 is closed, the microprocessor 61 operates the blowing fan 31 and the cooling fan 35 on the basis of the temperatures sensed by the temperature sensors 63, 65. That is, if the rise in the temperature of the area near the door 45 is sensed S5, the blowing fan 31 begins to operate S6, and if the area near the door 45 is cooled so that the temperature thereof reaches the temperature in the fresh food compartment 42 during the operation of the blowing fan 31, S7, the blowing fan 31 stops operating S8.

Since the air curtain is generated according to the temperature of the area near the door 45 and the state of the door 45, the leakage of the cool air is prevented when the door 45 is opened and the cooling intensity of the area near the door 45 is enhanced when the door 45 is closed.

As described above according to the present invention, the area near the door is cooled efficiently when the door is closed, and the operation for generating an air curtain is exactly performed when the door is opened even if the sensor for sensing the opening/closing of the door is out of order.

Although the present invention has been described and illustrated in detail, it is clearly understood that the same is by way of illustration and example only and is not to be taken by way of limitation, wherein the spirit and scope of the present invention is limited only by the terms of the appended claims.

What is claimed is:

1. A refrigerator having a cabinet forming a cooling compartment, a door mounted on said cabinet for opening/closing an opening of said cooling compartment, said refrigerator comprising:

a cool air duct having a cool air port opened at an area adjacent to the opening of said cooling compartment;

a fan for blowing cool air in said cool air duct to be discharged through the cool air port so as to generate an air curtain for shutting off the opening of said cooling compartment;

a means for sensing opening/closing of said door;

a means for sensing temperatures of areas adjacent to said door and distant from said door;

a control part for controlling said blowing fan to operate when an opened door is sensed by said opening/closing sensing means and when the temperature of the area adjacent to said door is sensed by said temperature sensing means to be higher than the temperature of the area distant from said door.

2. The refrigerator as claimed in claim 1, wherein said opening/closing sensing means is a push button switch being pushed and released when said door is closed and opened respectively.

3. The refrigerator as claimed in claim 1, wherein said temperature sensing means comprises, a door temperature sensor being disposed near said door in said compartment; and a cooling compartment temperature sensor being disposed at an opposite side wall to said door in said cooling compartment.

4. A method for controlling an air curtain generating operation in a refrigerator, said refrigerator having a cabinet forming a cooling compartment, a door mounted on said cabinet for opening/closing an opening of said cooling compartment, a cool air duct having a cool air port opened at an area adjacent to the opening of said cooling compartment, a fan for blowing cool air in said cool air duct to be discharged through the cool air port, wherein an air curtain for shutting off the opening of said cooling compartment is generated by the cool air discharged through the cool air port according to an operation of said blowing fan, said controlling method comprising the steps of:

sensing opening/closing of said door;

operating said blowing fan if said door is opened;

sensing temperatures of areas adjacent to said door and distant from said door; and controlling said blowing fan to operate when the temperature of the area adjacent to said door is sensed to be higher than the temperature of the area distant from said door.

* * * * *